US011718086B2

(12) United States Patent
Rudolph

(10) Patent No.: US 11,718,086 B2
(45) Date of Patent: Aug. 8, 2023

(54) PRINTING ASSEMBLY

(71) Applicant: Bobst Bielefeld GmbH, Bielefeld (DE)

(72) Inventor: Frank Rudolph, Versmold (DE)

(73) Assignee: Bobst Bielefeld GmbH, Bielefeld (DE)

( * ) Notice: Subject to any disclaimer, the term of this patent is extended or adjusted under 35 U.S.C. 154(b) by 0 days.

(21) Appl. No.: 17/804,130

(22) Filed: May 26, 2022

(65) Prior Publication Data

US 2022/0379596 A1 Dec. 1, 2022

(30) Foreign Application Priority Data

May 31, 2021 (EP) ..... 21176765

(51) Int. Cl.
*B41F 5/24* (2006.01)
*B41F 13/11* (2006.01)
*B41M 1/10* (2006.01)

(52) U.S. Cl.
CPC ..... *B41F 5/24* (2013.01); *B41F 13/11* (2013.01); *B41M 1/10* (2013.01); *B41P 2217/11* (2013.01); *B41P 2217/14* (2013.01)

(58) Field of Classification Search
CPC ..... B41P 2213/802
See application file for complete search history.

(56) References Cited

U.S. PATENT DOCUMENTS

2010/0132575 A1 6/2010 Mayor

FOREIGN PATENT DOCUMENTS

| | | | | |
|---|---|---|---|---|
| DE | 10024350 A1 * | 11/2001 | ..... | B41F 5/24 |
| DE | 10024350 A1 | 11/2001 | | |
| DE | 102012003157 A1 * | 8/2013 | ..... | B41F 11/00 |
| WO | 2012000948 A1 | 1/2012 | | |

* cited by examiner

*Primary Examiner* — Joshua D Zimmerman
(74) *Attorney, Agent, or Firm* — Bookoff McAndrews, PLLC

(57) ABSTRACT

A printing machine comprises a printing module (28) having a flexographic printing mode and a gravure printing mode, wherein the printing module comprises at least two printing cylinders (34, 36) defining the printing mode of the printing module, and a printing tool handling unit being configured for withdrawing and inserting the at least two printing cylinders (34, 36) from and into the printing module, respectively. The printing tool handling unit comprises a coupling interface and the at least two printing cylinders each comprise a complementary coupling interface such that the printing tool handling unit can at least temporarily be coupled to one or more of the at least two printing cylinders (34, 36) via the respective coupling interfaces.

20 Claims, 12 Drawing Sheets

PRINTING ASSEMBLY

CROSS-REFERENCE TO RELATED APPLICATION(S)

Figure 1:
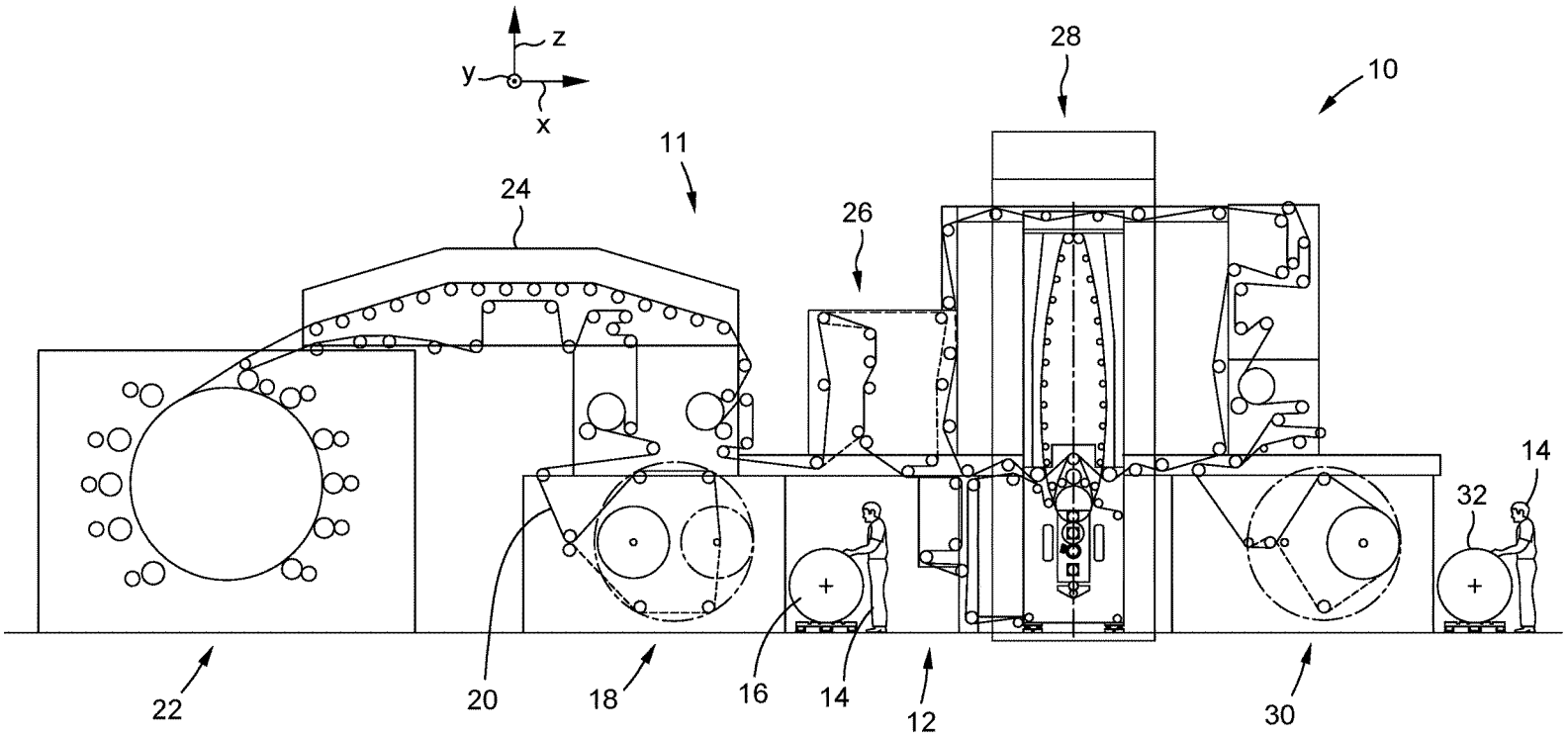

This patent application claims the benefit of priority to European Application No. 21176765.2, filed on May 31, 2021, the entirety of which is incorporated herein by reference.

The invention relates to a printing assembly comprising a printing machine and a printing tool handling unit.

Printing machines following different modes of action are known in the art and are used for different kinds of printing products. E.g., flexographic printing machines utilize so-called anilox rolls for taking up ink. Anilox rolls have engraved dimples on their surface in which the ink is collected and then transferred to a printing substrate. Flexographic printing is especially suited for uneven printing substrates due to the flexibility of the dimples. Gravure printing machines use gravure cylinders comprising depressions for taking up and transferring the ink to the printing substrate. Gravure printing machines are especially suitable for high-throughput applications.

Depending on the current print job at hand, manufacturers need to be able to easily choose the suitable printing mode. In known solutions, a combination of flexographic printing and gravure printing is typically realized by providing individual printing modules or individual printing machines for each type of printing. Therefore, space requirements and costs are high. Some printing machines comprise combined printing units which can be manually switched between a flexographic and a gravure printing mode. However, this change requires a high number of manual steps done by an operator of the printing machine which needs highly trained personnel, requires complex handling operations and makes extended set-up times of the printing machine necessary.

DE 100 24 350 A1 discloses a printing module having a flexographic and an intaglio printing mode based on a combination of an exchangeable printing cylinder 8 and a second printing cylinder with exchangeable sleeves. For switching between the different printing modes, the exchangeable printing cylinder is lowered onto a carriage system which is then used to withdraw the exchangeable printing cylinder from the printing module and inserting a different one. Then, the exchangeable sleeve is removed from the second printing cylinder and a new sleeve is mounted thereon.

WO 2012/000948 A1 discloses a flexographic printing machine with a plurality of printing stations. At least one of the printing stations has movable printing cylinders comprising an anilox roller and a printing plate cylinder, wherein the anilox roller can be replaced with an engraved roller and the printing plate cylinder can be replaced with a rubber roller.

US 2010/0132575 A1 shows a method of assembling or transforming a print unit belonging to a printing machine comprising a frame. By means of a print carriage, a doctor blade system can be inserted into and attached to the frame.

It is an object of the invention to provide a means for switching between flexographic and gravure printing in an easy and fast manner.

The object of the invention is solved by a printing machine according to claim 1.

The object of the invention is solved by a printing machine with a printing module having a flexographic printing mode and a gravure printing mode, wherein the printing module comprises at least two printing cylinders defining the printing mode of the printing module, and a printing tool handling unit being configured for withdrawing and inserting the at least two printing cylinders from and into the printing module, respectively. The printing tool handling unit comprises a coupling interface and the at least two printing cylinders each comprise a complementary coupling interface such that the printing tool handling unit can at least temporarily be coupled to one or more of the at least two printing cylinders via the respective coupling interfaces. Each of the coupling interfaces provided on the printing tool handling unit and each of the complementary coupling interfaces provided on the at least two printing cylinders are identical and/or standardized.

The printing assembly according to the invention allows for a fast procedure for switching between a flexographic printing mode and a gravure printing mode of a single printing module. Accordingly, it is not necessary to provide individual printing assemblies with each of these being configured for a single printing mode.

The printing module can be the only printing module of the printing machine or be used in combination with further printing modules. E.g., the printing module can be combined with a conventional flexographic printing module and/or a gravure printing module to allow for flexible printing processes using combined printing procedures. Also, the printing module can be combined with sheet-processing modules, e.g. with a creasing, cutting and/or folding module to allow a combined process including printing on a substrate and processing the substrate in a desired form.

In another preferred embodiment of the invention the printing machine may further comprises a digital printing unit. The digital printing unit may be used in addition to the other modules or instead, depending on the print job and the embodiment.

The printing tool handling unit of the printing assembly ensures a fast and easy switching procedure between the flexographic and gravure printing mode by means of the coupling interface and the complementary coupling interfaces. In the present context, "withdrawing" a printing tool from the printing module means unloading the printing tool from the printing module and "inserting" a printing tool into the printing module is the same as loading the printing tool into the printing module.

The printing tool handling unit can be coupled to a single one or more than one of the printing tools at the same time when withdrawing and/or inserting the printing tools.

The coupling interfaces provided on the printing tool handling unit and on each of the printing tools may are identical and/or are standardized. Therefore, the same coupling interface can be used for the different printing tools necessary for the different printing modes. This reduces the costs and complexity of the printing tool handling unit and decreases set-up times.

In the flexographic printing mode, the at least two printing cylinders can comprise a plate cylinder and an anilox roll.

In the gravure printing mode, the at least two printing cylinders comprise a gravure cylinder and a pressure roller.

In one variant, the printing module further comprises an ink tray which is displaceable between a rest position and an operation position, wherein the ink tray is in the rest position, when the printing module is in the flexographic printing mode and in the operation position when the printing module is in the gravure printing mode. In the rest position, the ink tray has no contact with the printing cylinders and in the operation position the ink tray is in contact with at least one of the printing cylinders for supplying ink to said printing cylinder.

Especially, the ink tray is in contact with the gravure cylinder for supplying ink to the gravure cylinder in the operation position.

By providing a displaceable ink tray, there is no need to insert and withdraw the ink tray when switching between the flexographic and gravure printing mode which can reduce the complexity of the printing tool handling unit and decreases the set-up time of the printing machine.

However, the printing tool handling unit can still be configured for withdrawing and inserting the ink tray from and into the printing module, respectively, e.g. to allow for an easy access to the ink tray for maintenance and for exchanging the ink tray at the end of its lifetime. For this purpose, the ink tray preferably comprises a coupling interface which is analogue to the complementary coupling interfaces of the printing cylinders, i.e. the printing tool handling unit can preferably be at least temporarily be coupled to the blade beam via the same coupling interface as is the case for the printing cylinders The ink tray can be displaceable by means of a linear guide and driven by a drive, e.g. a spindle drive.

The printing tool handling unit can be further configured for withdrawing and inserting a blade beam from and into the printing module, respectively.

This allows for easily providing the blade beam necessary for the respective printing mode. In the gravure printing mode, the blade beam is especially a doctor blade or squeegee. In the flexographic printing mode, the blade beam is especially a doctor chamber blade. Additionally, the blade beam necessary for the printing mode to be changed into can be prepared upfront of the set-up procedure for changing the printing mode, thereby reducing the actual down-times of the printing machine.

The blade beam preferably comprises a coupling interface which is analogue to the complementary coupling interfaces of the printing cylinders, i.e. the printing tool handling unit can preferably be at least temporarily be coupled to the blade beam via the same coupling interface as is the case for the printing cylinders.

To allow for a standardized supply with inks, the printing module can comprise an ink supply module which is in fluid connection with the printing module by means of an ink connector. In the flexographic printing mode, the ink connector is especially coupled by means of the ink connector to the chamber doctor blade. In the gravure printing mode, the ink connector is especially coupled by means of the ink connector to the ink tray. With other words, the ink connector, the doctor chamber blade and the ink tray especially use a standardized coupling to allow for an easy and fast exchange of the ink supply setup when switching between the flexographic and gravure printing mode.

For minimizing the space requirements and to allow for printing on a front side and a back side of a printing substrate, the printing cylinders are preferably arranged symmetrically along a vertical central axis of the printing module. With other words, the printing cylinders are preferably arranged along the vertical central axis on top of each other.

The printing cylinders are preferably be displaceable along the vertical central axis, e.g. driven by a drive like a spindle drive and guided along a linear guide. This allows optimizing the position of the printing cylinders before and/or after the printing tool handling unit has withdrawn and inserted the respective printing tools. E.g., before withdrawing the printing cylinders at least one of the printing cylinders is displaced to have no contact with other printing cylinders to allow for higher tolerances when being handled by the printing tool handling unit and minimizing the risk of damages of the printing cylinder during the set-up of the printing module.

The printing module can further comprise a drying unit which is arranged symmetrically along the vertical central axis of the printing module (28) and geodetically above the printing cylinders, wherein the drying unit (52) is configured to dry both the front and back side of a printed substrate (32). Especially, the drying unit is arranged geodetically above the printing cylinders. This allows for a very compact design of the printing module while providing drying of the printed substrate, especially drying of both the front and back side of the printed substrate.

According to a variant, the printing tool handling unit comprises an end effector, wherein the coupling interface is mounted on or provided at the end effector. The end effector and the coupling interface mounted thereon or provided thereat may thus be provided as a module which can be used in connecting with varying handling devices. Consequently, the printing tool handling unit can be produced and operated at comparatively low costs.

Preferably, the end effector is mounted at or provided on an end of an arm. A printing tool handling unit having such an arm is able to cover a relatively large range of motion. Consequently, the printing tool handling unit can interact with printing tools being arranged at different positions and especially different heights within the printing module.

In an especially preferred variant, the arm is a robot arm and thus the printing tool handling unit comprises an industrial robot. As a consequence thereof, the printing tool handling unit can rely on standard equipment which is to be equipped with the coupling interface. Further, the procedure for switching between the flexographic printing mode and the gravure printing mode can be performed fully automatically for minimizing the set-up time of the printing machine.

According to a further variant, at least one of the printing cylinders is a roller assembly comprising a shaft and a sleeve mounted onto the shaft, wherein the complementary coupling interface is located at an end of the shaft. Thus, the printing cylinder can be maneuvered in a stable and reliable manner. Moreover, the risk of damaging a sleeve and/or an adapter of the printing cylinder is reduced. This is especially true in comparison to known printing tools, wherein the sleeve and/or the adapter are gripped when performing an exchange procedure.

Further, at least one of the printing cylinders can be formed as a beam, wherein the complementary coupling interface is located at an end of the beam. Thus, also beam-shaped printing tools can be exchanged in a simple and reliable manner.

Figure 2:
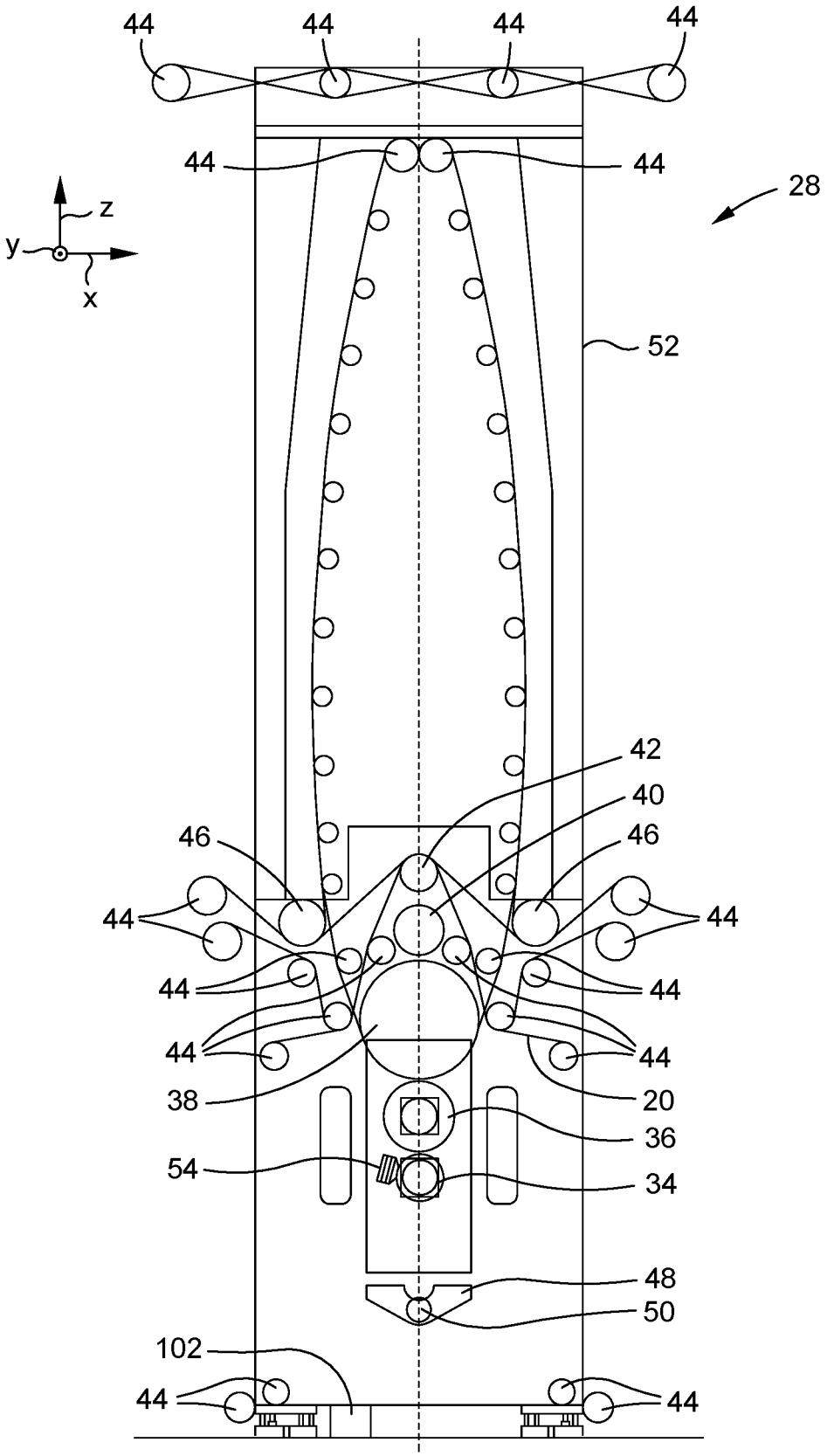
Figure 3:
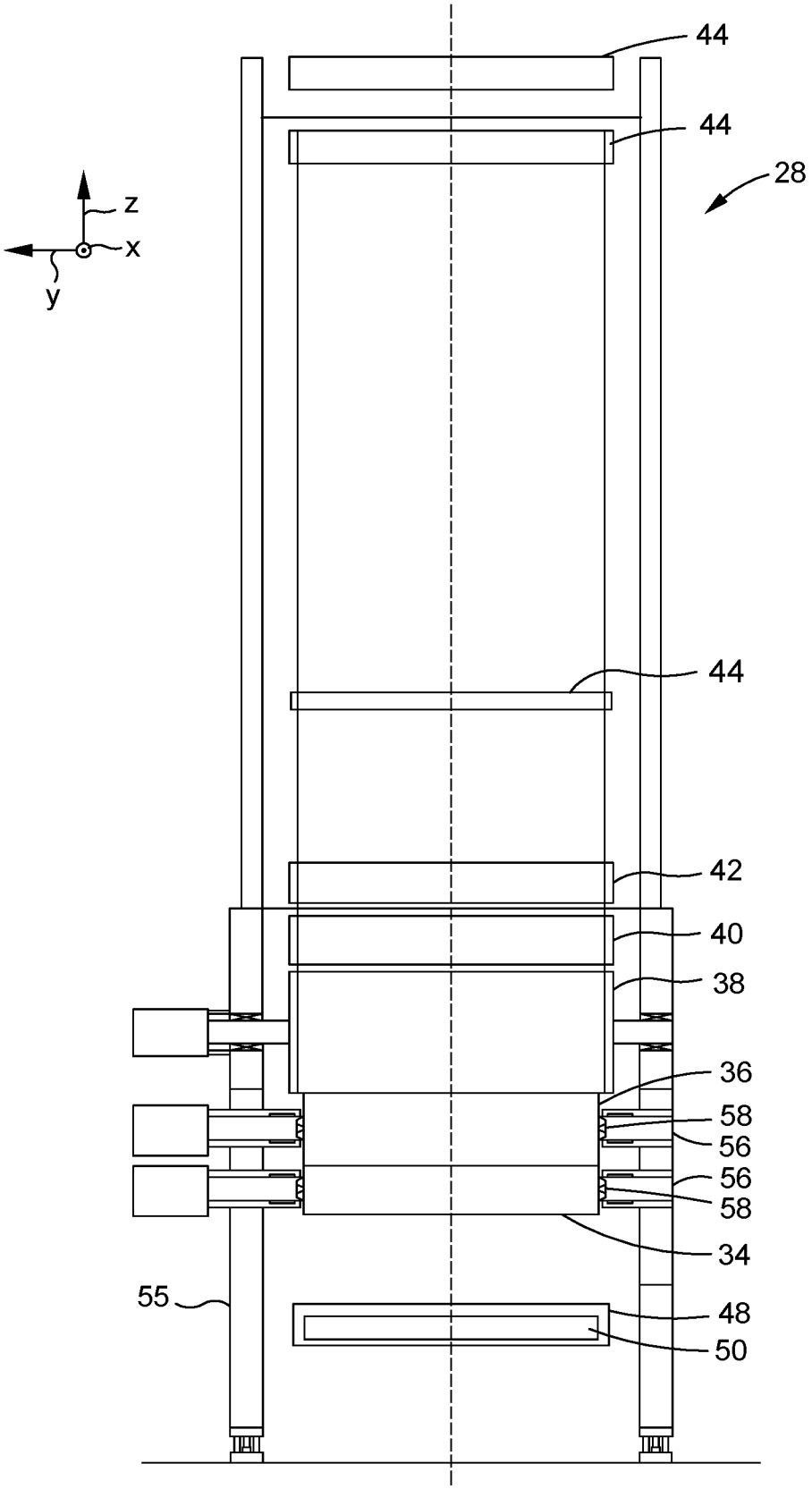
Figure 4:
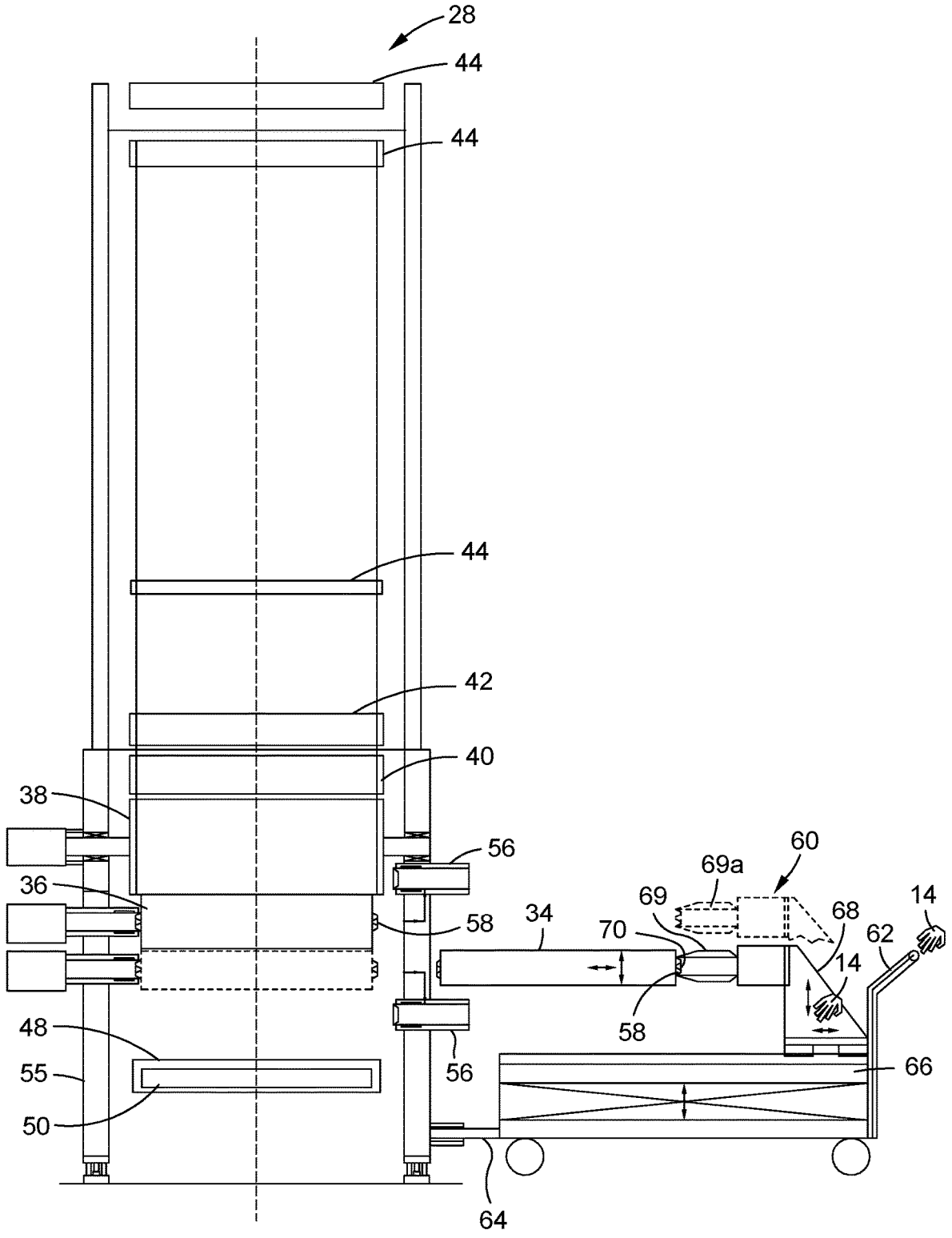
Figure 5A:
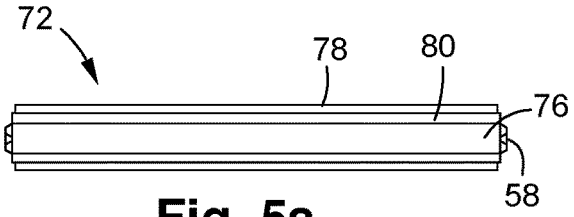
Figure 6A:
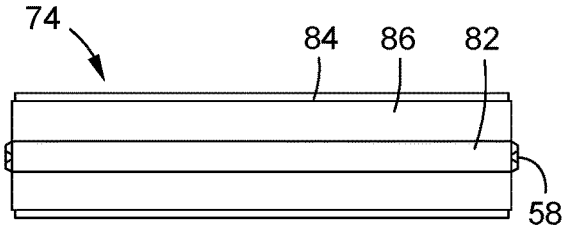
Figure 5B:
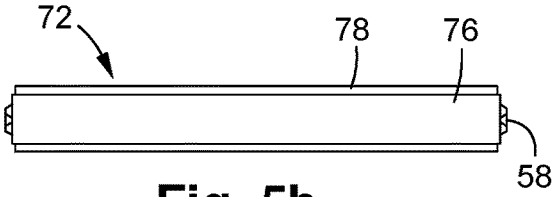
Figure 6B:
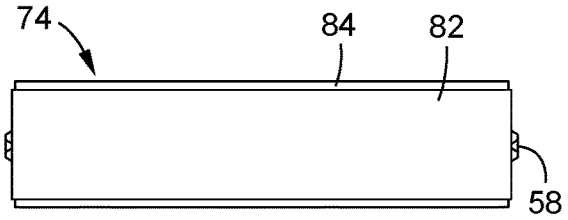
Figure 5C:
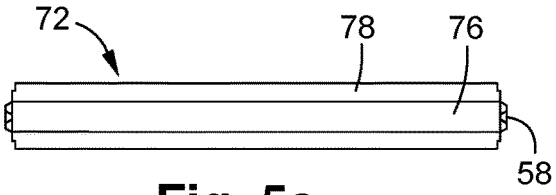
Figure 7A:
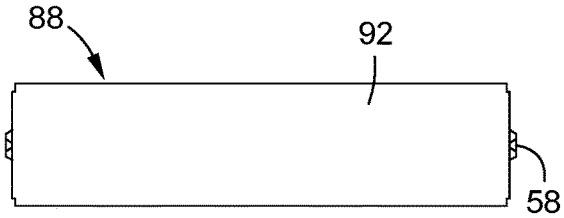
Figure 8A:
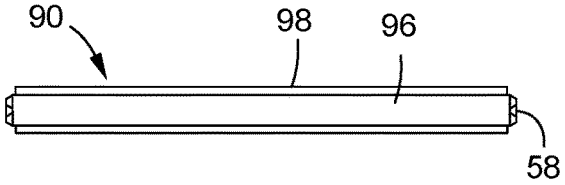
Figure 7B:
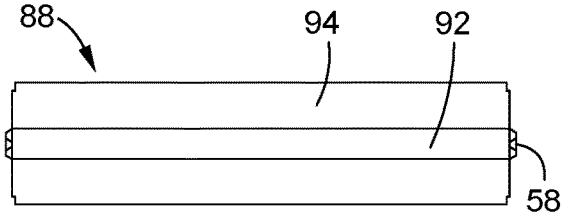
Figure 8B:
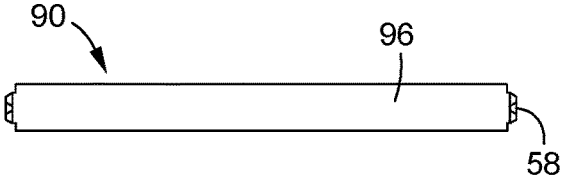
Figure 9:
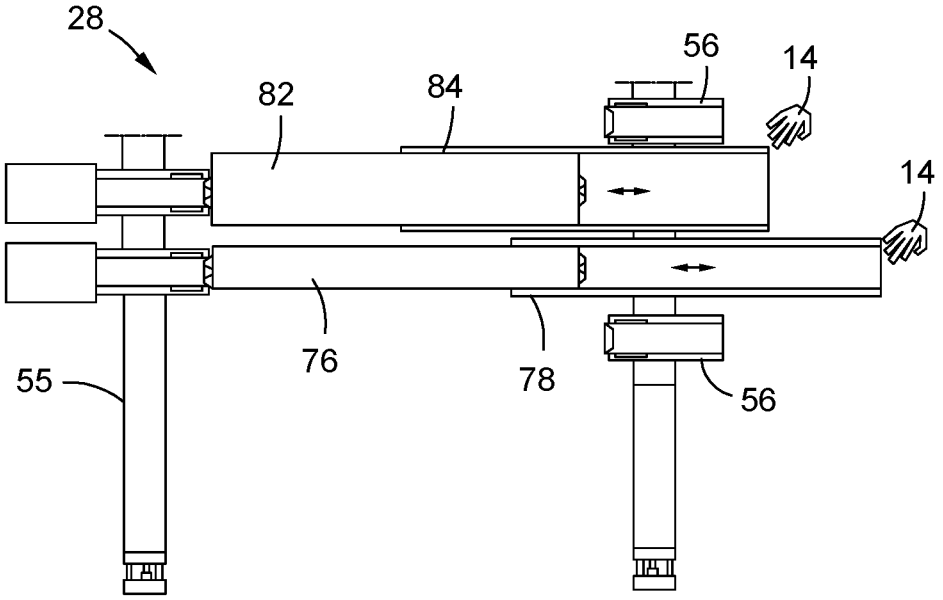
Figure 10:
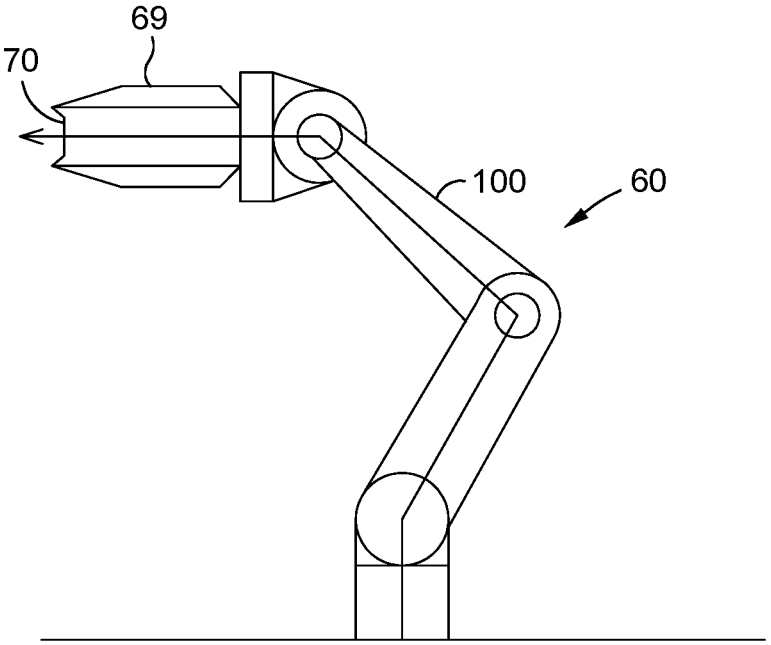
Figure 11:
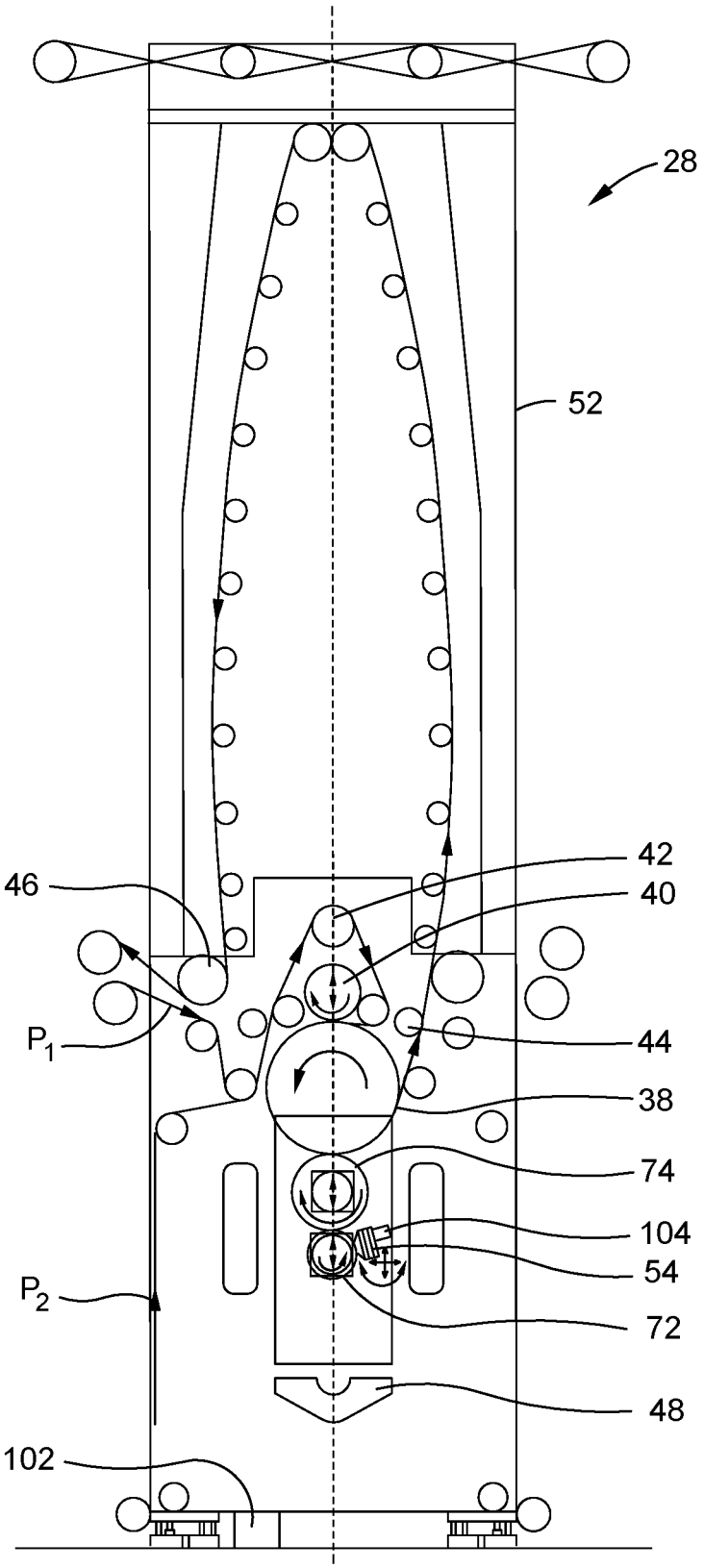
Figure 12:
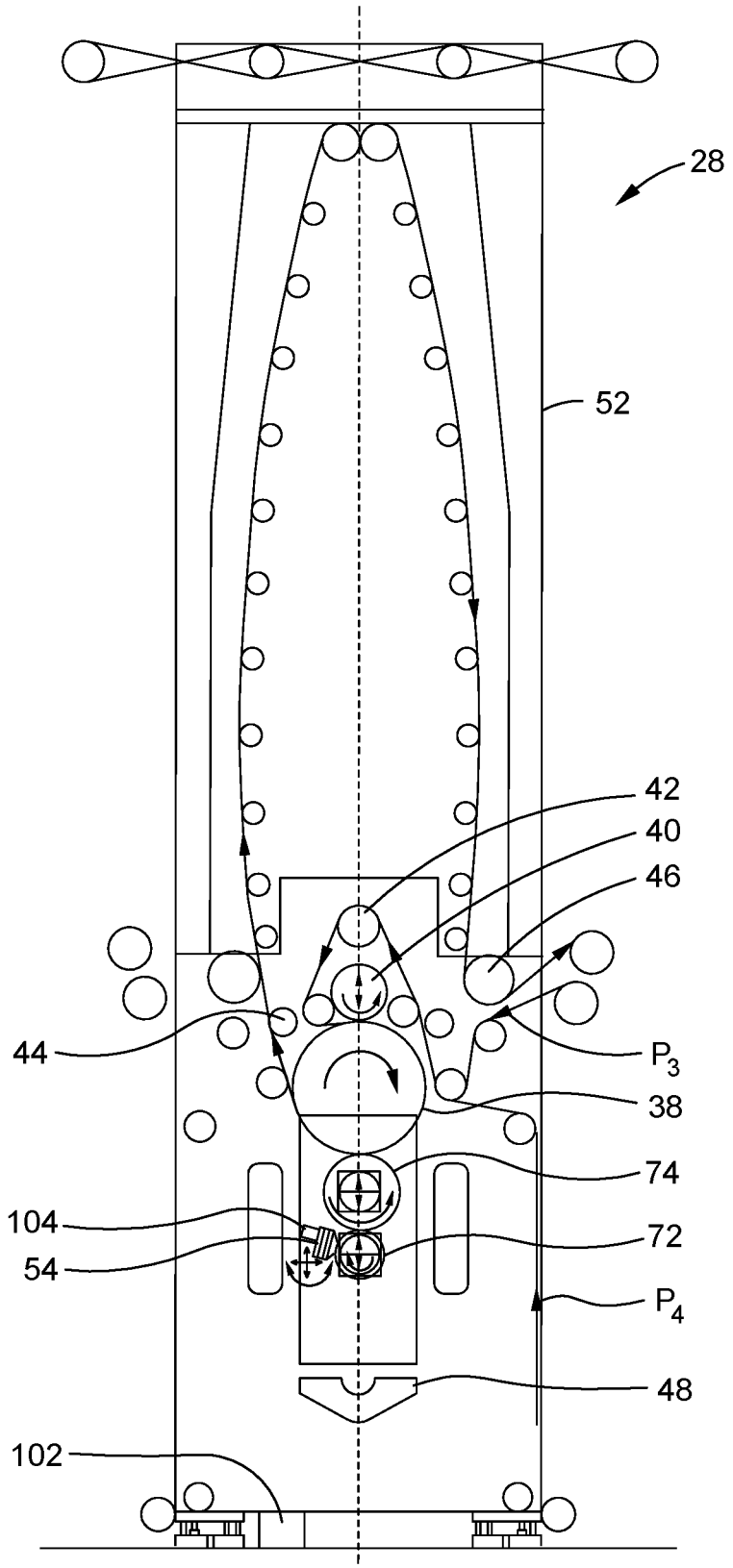
Figure 13:
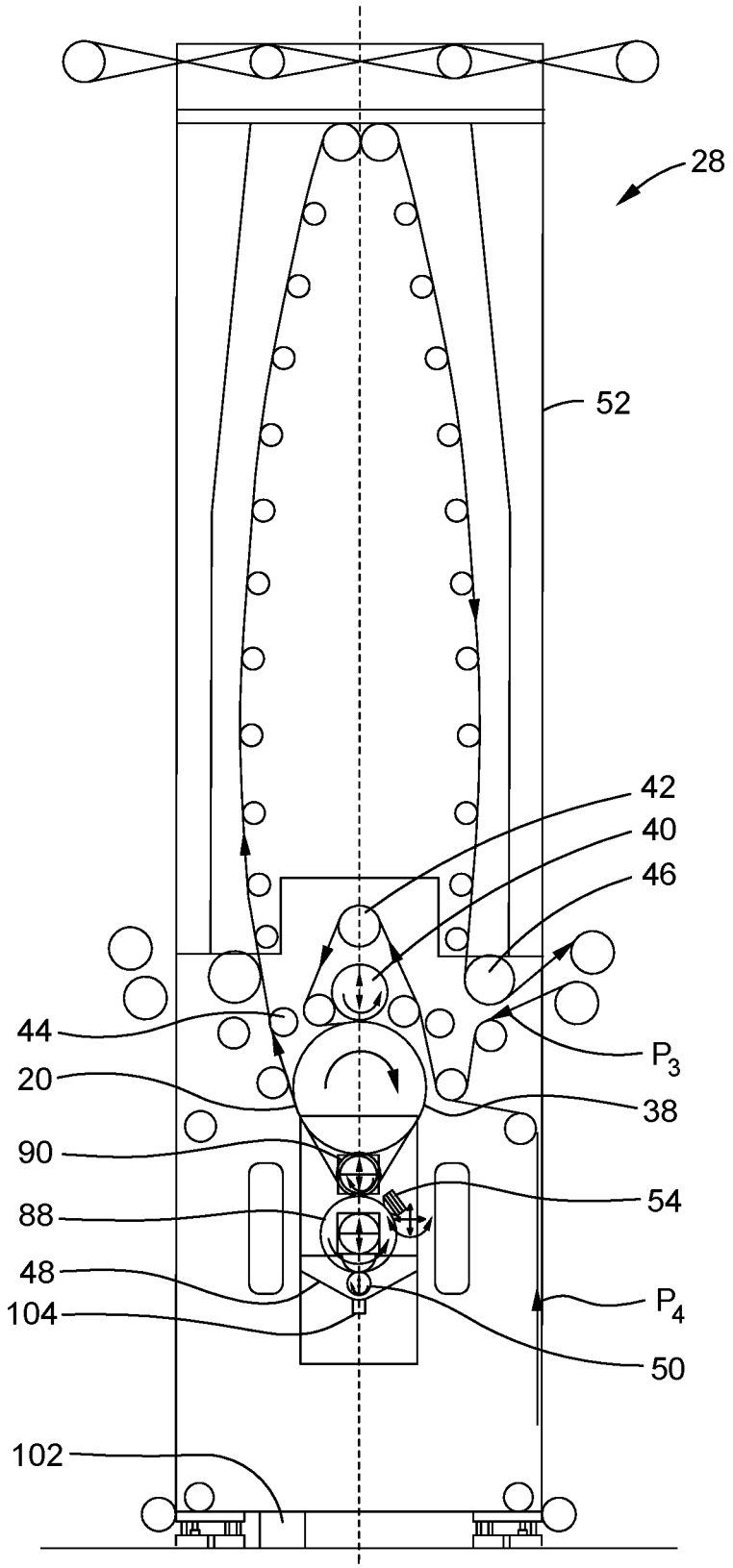
Figure 14:
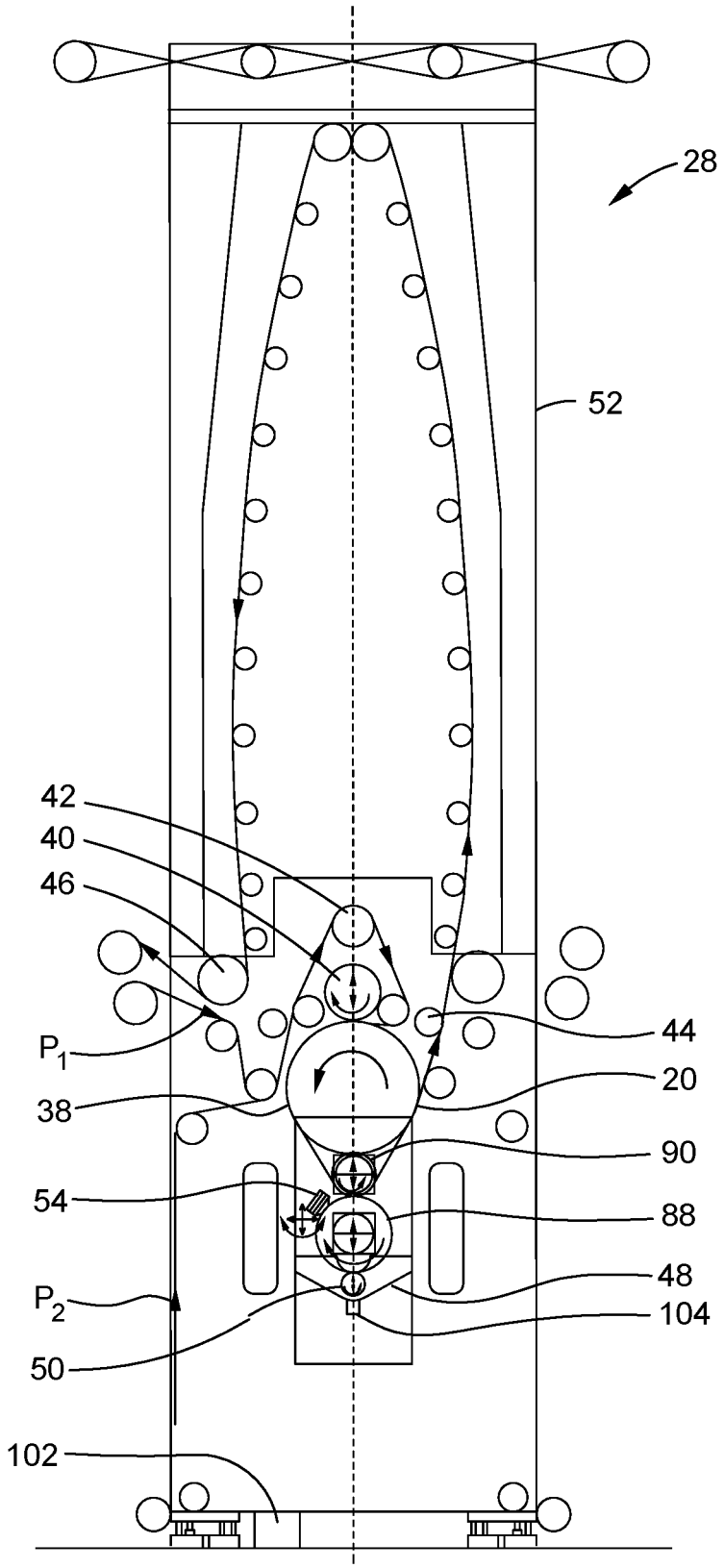
Figure 15:
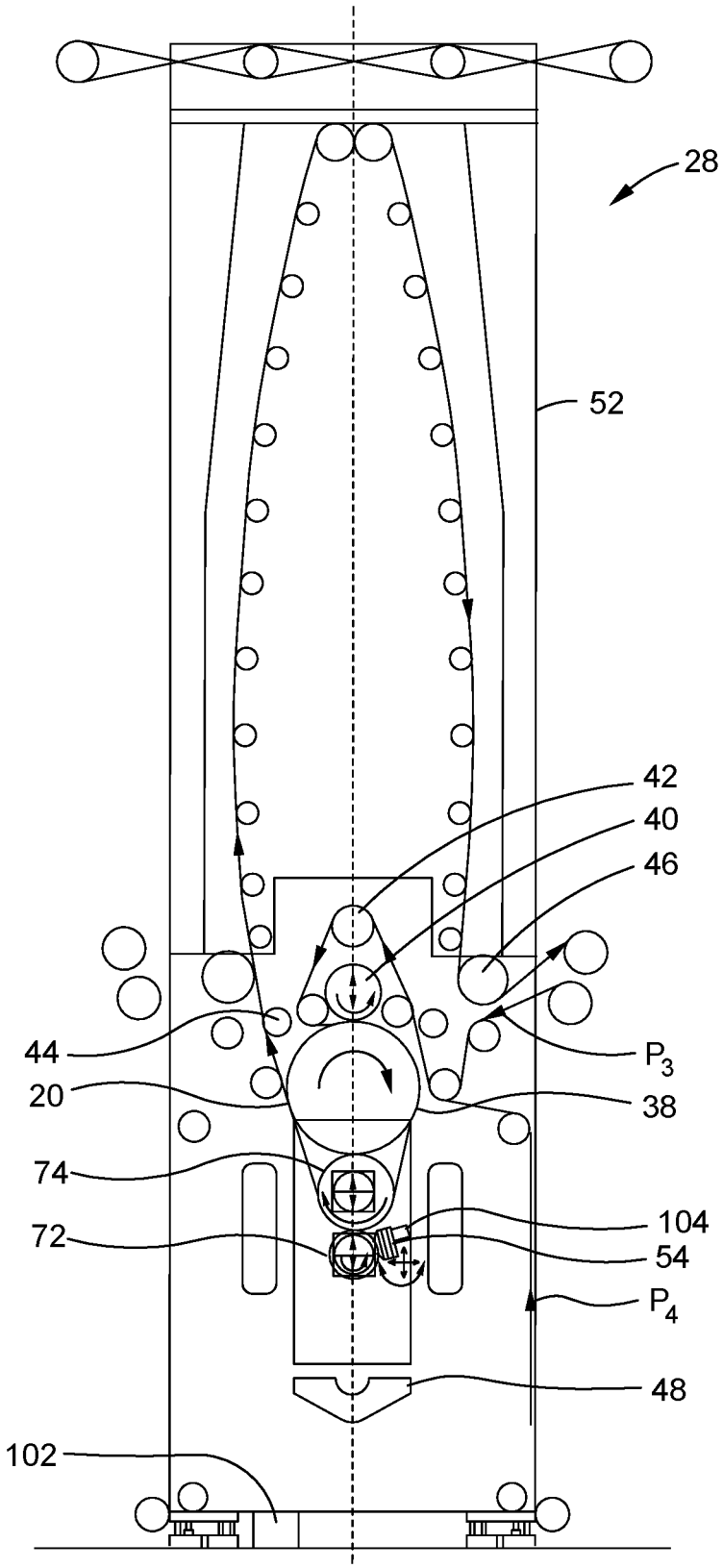
Figure 16:
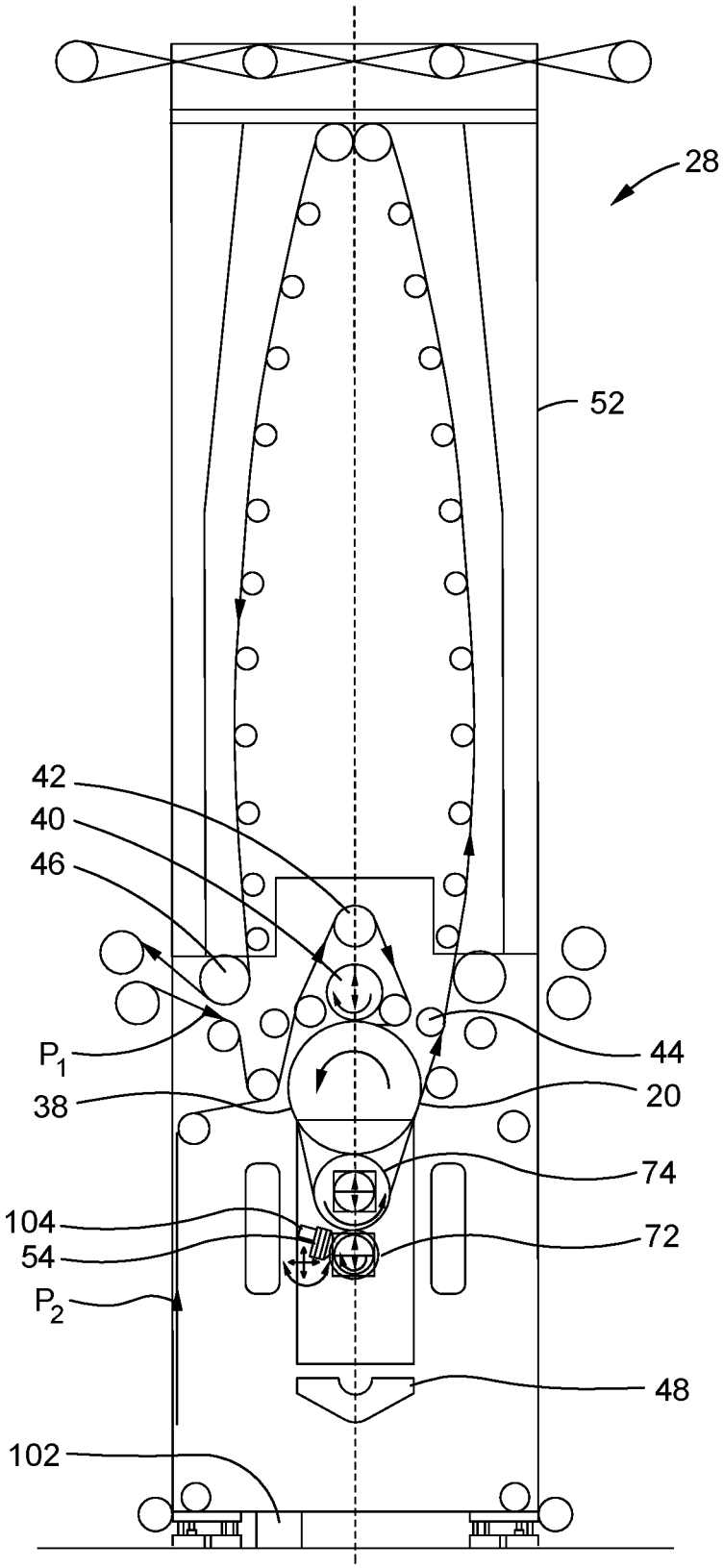

Further advantages and features will become apparent from the following description of the invention and from the appended figures which show non-limiting exemplary embodiments of the invention and in which:

FIG. 1 schematically shows a printing assembly with a printing module according to the invention, FIG. 2 shows a sectional front view of the printing module of FIG. 1 in more detail, FIG. 3 shows a sectional side view of the printing module of FIG. 1 in more detail, FIG. 4 shows the printing module of FIG. 3 during a procedure for switching the printing mode, FIGS. 5*a* to 5*c* show different embodiments of an anilox roll of the printing module of FIG. 1, FIGS. 6*a* to 6*b* show different embodiments of a plate cylinder of the printing module of FIG. 1, FIGS. 7*a* to 7*b* show different embodiments of a gravure cylinder of the printing module of FIG. 1, FIGS. 8*a* to 8*b* show different embodiments of a pressure cylinder of the printing module of FIG. 1, FIG. 9 shows selected parts of the printing module of FIG. 3 during a procedure for switching the printing mode, FIG. 10 shows an embodiment of a printing tool handling unit of the printing assembly of FIG. 1, FIG. 11 shows the printing module of FIG. 2 in a flexographic printing mode, FIG. 12 shows the printing module of FIG. 2 in an alternative flexographic printing mode, FIG. 13 shows the printing module of FIG. 2 in a gravure printing mode, FIG. 14 shows the printing module of FIG. 2 in an alternative gravure printing mode, FIG. 15 shows the printing module of FIG. 2 in a further alternative flexographic printing mode, and FIG. 16 shows the printing module of FIG. 2 in yet another alternative flexographic printing mode.

FIG. 1 schematically shows a printing assembly 10 according to the invention comprising a printing machine 11.

The printing assembly 10 comprises a loading station 12 from which an operator 14 can load a printing substrate 16 into an unwinding station 18.

The printing substrate 16 can be paper, foil or any other suitable printing substrate 16 as known in the art.

From the unwinding station 18, the printing substrate 16 is guided in form of a material web 20 towards a flexographic printing station 22 which is a satellite flexographic printing station.

The material web 20 is then dried in a drying tunnel 24 and transported through a web inspection station 26 to a printing module 28.

The printing module 28 has a flexographic printing mode and a gravure printing mode. Accordingly, different types of printing operations can be achieved by the printing module 28.

From the printing module 28, the material web 20 is then transported to a rewinding station 30 from which the finished printed substrate 32 can be collected by the operator 14.

In the shown embodiment, the printing module 28 is combined with a flexographic printing station 22. However, as will be apparent for one skilled in the art, the printing assembly 10 could also merely use one or more printing modules 28, i.e. without using other types of printing stations, and/or other kinds of additional printing stations and additional processing stations.

In FIG. 2, the printing module 28 is shown in more detail.

The printing module 28 comprises several printing cylinders which are arranged along a vertical central axis of the printing module 28 indicated by the dashed line in FIG. 2.

From bottom to top along the vertical central axis are arranged a first printing cylinder 34, a second printing cylinder 36, an impression cylinder 38, a nip roll 40 and a tension sensing roller 42 for measuring the tension of the material web 20.

The material web 20 is guided to, within and from the printing module 28 by a multitude of guide rollers 44 and is heated or cooled to a target temperature by temperature control rollers 46.

The printing module 28 further comprises an ink tray 48 which is displaceable along the vertical central axis by means of a (not shown) drive and guided along (not shown) linear guides. A fountain roller 50 is arranged in the ink tray 48.

Arranged geodetically above the series of printing cylinders, the printing module 28 has a drying unit 52.

Additionally, the printing module 28 has two mounting positions for a blade beam 54, wherein in the embodiment shown in FIG. 2 the blade beam 54 is a doctor chamber blade arranged for interaction with the first printing cylinder 34.

In FIG. 3, a sectional side view of the printing module 28 is shown.

From this depiction of the printing module 28, it can be noted that the first printing cylinder 34, the second printing cylinder 36 and the impression cylinder 38 are mounted to a machine frame 55 of the printing module 28.

More precisely, the first printing cylinder 34 and the second printing cylinder 36 are coupled to support shafts 56 by means of a complementary coupling interface 58 at an end of the respective printing cylinder.

The support shafts 56 are further rotatorily held in the machine frame 55.

The first printing cylinder 34 and the second printing cylinder 36 can be withdrawn from and inserted into the printing module 28 which is illustrated in FIG. 4.

To this end, the support shafts 56 are uncoupled from the respective printing cylinders to be withdrawn and moved away from the printing cylinders along an L-shaped path as indicated by arrows in FIG. 4.

This enables the first printing cylinder 34 and the second printing cylinder 36 to be removed from the printing module 28 by a printing tool handling unit 60.

In the embodiment shown in FIG. 4, the printing tool handling unit 60 is a wagon 62 which is manually operated by the operator 14.

The wagon comprises a spacer element 64 for aligning the wagon 62 relative to the machine frame 55.

Furthermore, the wagon 62 has a lifting platform 66 on which an alignment element 68 is located. The alignment element 68 is further connected to an end effector 69 which comprises coupling interface 70 with which the end effector 69 can be at least temporarily coupled to the complementary coupling interface 58 of the first printing cylinder 34 and the second printing cylinder 36.

The alignment element 68 is movably mounted on the lifting platform 66 such that the end effector 69 can be suitably arranged for being coupled to the respective printing cylinder, as further illustrated by the dashed end effector 69*a* in FIG. 4.

The procedure for switching the first printing cylinder 34 and the second printing cylinder 34 is therefore as follows: First, the first printing cylinder 34 and the second printing cylinder 36 are uncoupled from the support shafts 56, followed by a movement of the support shafts 56 along an L-shaped path as shown in FIG. 4. This enables access to the first printing cylinder 34 and the second printing cylinder 36 from a so-called operator side of the printing module 28. Then, the operator 14 positions the wagon 62 in front of the machine frame 55, especially by means of the spacer element 64. This is followed by arranging the lifting platform 66 and the alignment element 68 such that the coupling interface 70 of the end effector 69 and the complementary coupling interface 58 of the first printing cylinder 34 are aligned to allow a temporary coupling of the first printing cylinder 34 and the end effector 69. The end effector 69 is then retracted by means of a movement of the alignment element 68, thereby withdrawing the first printing cylinder 34 from the printing module 28. Afterwards, a new printing cylinder 34 is temporarily coupled to the end effector 69 and inserted into the printing module 28 by a reversed order of steps. The same procedure is then repeated for the second printing cylinder 36.

Of course, both the first printing cylinder 34 and the second printing cylinder 36 can be withdrawn from the printing module 28 before inserting new printing cylinders or the second printing cylinder 36 can be exchanged before or at the same time as the first printing cylinder 34.

This procedure can also be automated if the operation of the wagon 62 is not done by the operator 14 but is controlled in an automated manner, e.g. by a (not shown) central operating device of the printing assembly 10.

The printing mode of the printing module 28 is defined by the kind of first printing cylinder 34 and second printing cylinder 36 installed in the printing module 28, wherein the printing module 28 according to the invention can be in a flexographic printing mode or in a gravure printing mode.

In the flexographic printing mode, the first printing cylinder 34 especially is an anilox roll 72 and the second printing cylinder 36 is a plate cylinder 74. Exemplary constructions of the anilox roll 72 are shown in FIGS. 5*a* to 5*c* and exemplary constructions of the plate cylinder 74 are shown in FIGS. 6*a* and 6*b*.

The anilox roll 72 comprises an anilox shaft 76 on which an anilox sleeve 78 is mounted. Optionally, the anilox sleeve 78 is coupled to the anilox shaft 76 by an anilox adapter 80 arranged between the anilox sleeve 78 and the anilox shaft 76 (see FIGS. 5*a* to 5*c*).

Similarly, the plate cylinder 74 comprises a plate cylinder shaft 82 on which a plate cylinder sleeve 84 is mounted, with an optional plate cylinder adapter 86 mounted there between (see FIGS. 6*a* and 6*b*).

The anilox adapter 80 and the plate cylinder adapter 86 allow to secure the anilox sleeve 78 and the plate cylinder sleeve 84, respectively, e.g. pneumatically or hydraulically.

In the gravure printing mode, the first printing cylinder 34 especially is a gravure cylinder 88 and the second printing cylinder 36 is a pressure roller 90. Exemplary constructions of the gravure cylinder 88 are shown in FIGS. 7*a* and 7*b* and exemplary constructions of the pressure roller 90 are shown in FIGS. 8*a* and 8*b*.

The gravure cylinder 88 can have a mere gravure cylinder shaft 92 or a gravure cylinder shaft 92 with a gravure cylinder sleeve 94 mounted thereon (see FIGS. 7*a* and 7*b*).

Similarly, the pressure roller 90 can have a mere pressure roller shaft 96 or a pressure roller shaft 96 with a pressure roller sleeve 98 mounted thereon (see FIGS. 8*a* and 8*b*).

With other words, the gravure cylinder 88 and/or the pressure roller 90 can be formed as a beam.

In FIG. 9, an intermediate state for preparing the printing module 28 for the flexographic printing mode is shown for the case that a plate cylinder 74 as shown in FIG. 6*b* is used as second printing cylinder 36 and an anilox roll as shown in FIG. 5*b* is used as first printing cylinder 34.

In the shown embodiment, the anilox shaft 76 and the plate cylinder shaft 82 have been already inserted in the printing module 28 by the printing tool handling unit 60. Afterwards, the anilox sleeve 78 and the plate cylinder sleeve 84 are mounted on the anilox shaft 76 and the plate cylinder shaft 82, respectively, by the operator 14. Using sleeves for the anilox roll 72 and the plate cylinder 74 also allows for short set-up times between print jobs if the printing mode of the printing module 28 is not be changed.

As one skilled in the art will appreciate, the printing assembly 10 according to the invention also allows for inserting and withdrawing the first printing cylinder 34 and the second printing cylinder 36 without having to manually manipulate the respective sleeves, too. Also, instead of a manual exchange of the sleeves by the operator, the exchange can be automatically done by the printing tool handling unit 60.

In FIG. 10, an alternative embodiment of the printing tool handling unit 60 is shown. In this embodiment, the printing tool handling unit 60 comprises an arm 100 on which the end effector 69 with the coupling interface 70 is mounted.

The arm 100 is preferably a robot arm and the printing tool handling unit 60 is preferably operated automatically. This allows for a further reduction of the set-up time of the printing machine 11 and increases reproducibility and reliability of the procedure for inserting and withdrawing printing tools from the printing module 28.

In the following, different printing modes of the printing module 28 are described in more detail.

In FIG. 11, the printing module 28 is shown in a flexographic printing mode, in which an anilox roll 72 is used as first printing cylinder 34 and a plate cylinder 74 is used as second printing cylinder 36.

For supplying ink to the anilox roll 72, a doctor chamber blade is used as blade beam 54, wherein the doctor chamber blade is arranged on the right hand side of the vertical axis in the perspective chosen in FIG. 11.

The doctor chamber blade is supplied with ink from an ink supply module 102 of the printing assembly 10, wherein the ink supply module 102 and the doctor chamber blade are fluidly connected by means of a (not shown) ink supply line and an ink connector 104.

As indicated by arrows in FIG. 11, the anilox roll 72 and the plate cylinder 74 are displaceable along the vertical central axis of the printing module 28 to ensure correct positioning and a sufficient pressure between the anilox roll 72 and the plate cylinder 74 as well as between the plate cylinder 74 and the impression cylinder 38.

The chamber doctor blade is displaceable both parallel and perpendicular to the vertical central axis and is rotatable such that the chamber doctor blade can follow the movement of the anilox roll 72 and ensure sufficient contact for a consistent transfer of ink to the anilox roll 72.

The ink tray 48 is in a rest position and has no contact with the anilox roll 72.

In FIG. 11, the course of the material web 20 is indicated by arrows wherein two different possible entry points are indicated by the arrows $P_1$ and $P_2$, respectively. Which of these entry points are used, depends on the further components of the printing assembly 10.

The material web 20 is guided by the guide rollers 44 to the impression cylinder 38 passing the tension sensing roller 42. The impression cylinder 38 is also responsible for keeping the desired web tension.

The material web 20 is then passing the plate cylinder 74 such that ink is transferred from the plate cylinder 74 to the printing substrate 16 forming the material web 20.

The ink is constantly supplied to the plate cylinder 74 by means of the anilox roll 72.

After being printed upon, the material web 20 then enters the drying unit 52 from which it is passed to the temperature control roller 46 before leaving the printing module 28 towards further processing steps of the printing assembly 10.

In FIG. 12, an alternative flexographic printing mode of the printing module 28 is depicted, which essentially corresponds to the flexographic printing mode described above.

However, the blade beam 54 has been rearranged to the left hand side of the central vertical axis in the in the perspective chosen in FIG. 12 and the direction of rotation of the involved cylinders and rolls have been inverted according to the inverted path of the material web 20 which is essentially mirrored to the one shown in FIG. 11 based on two different possible entry points as highlighted by the arrows $P_3$ and $P_4$, respectively.

The alternative flexographic printing mode allows printing on the backside of the material web 20 without any further changes to the printing assembly 10.

The printing assembly 10 according to the invention allows for easily switching between the flexographic printing mode shown in FIG. 11 and the one shown in FIG. 12 by merely re-arranging the blade beam 54.

Preferably, the position of the blade beam can be changed by interaction with the printing tool handling unit 60, i.e. the blade beam 54 preferably comprises a coupling interface which is analogue to the complementary coupling interfaces 58 of the printing cylinders.

In FIG. 13, the printing module 28 is shown in a gravure printing mode, in which a gravure cylinder 88 is used as first printing cylinder 34 and a pressure roller 90 is used as second printing cylinder 36.

For constantly supplying ink to the gravure cylinder 88, the ink tray 48 is in the operation position in which the fountain roller 50 of the ink tray 48 is in contact with the gravure cylinder 88.

The ink tray 48 is supplied with ink from the ink supply module 102, wherein the ink supply module 102 and the ink tray 48 are fluidly connected by means of the (not shown) ink supply line and the ink connector 104.

As blade beam 54, a squeegee is used in the shown embodiment of the gravure printing mode. The squeegee removes excess ink from the surface of the gravure cylinder 88, i.e. ink which is not in depressions of the gravure cylinder 88.

The squeegee is arranged on the right hand side of the vertical axis in the perspective chosen in FIG. 13.

As indicated by arrows in FIG. 13, the gravure cylinder 88 and the pressure roller 90 are displaceable along the vertical central axis of the printing module 28 to ensure correct positioning and a sufficient pressure between the gravure cylinder 88 and the pressure roller 90 as well as between the pressure roller 90 and the impression cylinder 38.

The squeegee is displaceable both parallel and perpendicular to the vertical central axis and is rotatable such that the squeegee can follow the movement of the gravure cylinder 88 and ensure sufficient contact for a consistent removal of excess ink from the gravure cylinder 88.

In FIG. 13, the course of the material web 20 is indicated by arrows. As can be seen, the same possible entry points indicated by the arrows $P_3$ and $P_4$, respectively, are used as for the flexographic printing mode as shown in FIG. 12.

However, the course of the material web 20 is different in the gravure printing mode. The material web 20 is guided by the guide rollers 44 to the pressure sensing roller 42 to the impression cylinder 38 before passing the pressure roller 90 such that ink is transferred from the gravure cylinder 88 to the printing substrate 16 forming the material web 20.

Therefore, in this embodiment of the gravure printing mode, the pressure roller 90 and not the impression cylinder 38 is responsible for keeping the desired web tension.

After being printed upon, the material web 20 enters the drying unit 52 from which it is passed to the temperature control roller 46 before leaving the printing module 28 towards further processing steps of the printing assembly 10.

In FIG. 14, an alternative gravure printing mode of the printing module 28 is depicted, which essentially corresponds to the gravure printing mode described above.

However, the blade beam 54 has been rearranged to the left hand side of the central vertical axis in the perspective chosen in FIG. 14 and the direction of rotation of the involved cylinders and rolls have been inverted according to the inverted path of the material web 20 which is essentially mirrored to the one shown in FIG. 13 based on two different possible entry points as highlighted by the arrows $P_1$ and $P_2$, respectively.

The alternative gravure printing mode allows printing on the backside of the material web 20 without any further changes to the printing assembly 10.

The printing assembly 10 according to the invention allows for easily switching between the gravure printing mode shown in FIG. 13 and the one shown in FIG. 14 by merely re-arranging the blade beam 54.

In FIG. 15, a further alternative flexographic printing mode is shown schematically.

In this flexographic printing mode, the type and arrangement of printing tools, i.e. of the blade beam 54 and of the printing cylinders, is equivalent to the arrangement shown in FIG. 11 and reference is made to the explanations above.

However, the course of the material web 20 is analogue to the one discussed in regard to the gravure printing mode as shown in FIG. 13, i.e. printing on the backside of the material web 20. With other words, the flexographic printing mode of FIG. 15 is a hybrid printing mode with the printing tools defining the flexographic printing mode but using an gravure printing mode course of the material web 20.

From the above it becomes clear that the printing module 28 can be run in a highly flexible manner which facilitates the implementation of the printing module 28 in the printing assembly 10.

In FIG. 16, yet another alternative flexographic printing mode is shown schematically.

In this flexographic printing mode, the type and arrangement of printing tools, i.e. of the blade beam 54 and of the printing cylinders, is equivalent to the arrangement shown in FIG. 12 and reference is made to the explanations above.

However, the course of the material web 20 is analogue to the one discussed in regard to the gravure printing mode as shown in FIG. 14. With other words, the flexographic printing mode of FIG. 16 is a hybrid printing mode with the printing tools defining the flexographic printing mode but using a gravure printing mode course of the material web 20.

In contrast to the flexographic printing mode of FIG. 15, the arrangement as shown in FIG. 16 allows to print on the front side of the material web 20.

The printing module 28 allows to change between flexographic and gravure printing in a fast and easy manner, thereby decreasing set-up times of the printing assembly 10 considerably. Further, the printing module 28 is compact while allowing printing on the front and back side of the printing substrate 16. Further, changing between the printing modes can be fully automated and different kinds of printing cylinders can be used, further reducing costs and increasing runtime of the printing assembly 10 comprising the printing module 28.

The invention claimed is:

1. A printing assembly comprising:

a printing machine with a printing module having a flexographic printing mode and a gravure printing mode, wherein the printing module comprises at least two printing cylinders defining the flexographic printing mode and the gravure printing mode of the printing module, and a printing tool handling unit being configured for withdrawing and inserting the at least two printing cylinders from and into the printing module, respectively, wherein the printing tool handling unit comprises a coupling interface and the at least two printing cylinders each comprise a complementary coupling interface such that the printing tool handling unit can couple to each of the at least two printing cylinders via the coupling interface on the printing tool handling unit and the complementary coupling interface on each of the at least two printing cylinders, wherein each of the complementary coupling interfaces provided on the at least two printing cylinders are identical and complementary to the coupling interface on the printing tool handling unit.

2. The printing assembly according to claim 1, wherein the printing machine further comprises a digital printing unit.

3. The printing assembly according to claim 1, wherein the at least two printing cylinders comprise a plate cylinder and an anilox roll in the flexographic printing mode.

4. The printing assembly according to claim 1, wherein the at least two printing cylinders comprise a gravure cylinder and a pressure roller in the gravure printing mode.

5. The printing assembly according to claim 1, wherein the printing module further comprises an ink tray which is displaceable between a rest position and an operation position, wherein the ink tray is in the rest position when the printing module is in the flexographic printing mode and in the operation position when the printing module is in the gravure printing mode, and wherein the ink tray has no contact with the printing cylinders in the rest position and is in contact with at least one of the printing cylinders in the operation position for supplying ink to the printing cylinder.

6. The printing assembly according to claim 1, wherein the printing tool handling unit is further configured for withdrawing and inserting a blade beam from and into the printing module, respectively.

7. The printing assembly according to claim 1, wherein the printing machine comprises an ink supply module which is in fluid connection with the printing module via an ink connector.

8. The printing assembly according to claim 1, wherein the printing cylinders are arranged along a vertical central axis of the printing module on top of each other.

9. The printing assembly according to claim 8, wherein the at least two printing cylinders are displaceable along the vertical central axis.

10. The printing assembly according to claim 8, wherein the printing module further comprises a drying unit which is arranged along the vertical central axis of the printing module and geodetically above the printing cylinders, wherein the drying unit is configured to dry both a front side and a back side of a printed substrate.

11. The printing assembly according to claim 1, wherein the printing tool handling unit comprises an end effector, wherein the coupling interface is mounted on or provided at the end effector.

12. The printing assembly according to claim 11, wherein the end effector is mounted at or provided on an end of an arm.

13. The printing assembly according to claim 1, wherein at least one of the printing cylinders is a roller assembly comprising a shaft and a sleeve mounted onto the shaft, wherein the complementary coupling interface is located at an end of the shaft.

14. The printing assembly according to claim 1, wherein at least one of the printing cylinders is formed as a beam, and wherein the complementary coupling interface is located at an end of the beam.

15. A printing assembly comprising:

a printing machine with a printing module having a flexographic printing mode and a gravure printing mode, wherein the printing module comprises at least two printing cylinders defining the flexographic printing mode and the gravure printing mode of the printing module, and a printing tool handling unit being configured for withdrawing and inserting the at least two printing cylinders from and into the printing module, respectively, wherein the printing tool handling unit comprises a standard coupling interface and the at least two printing cylinders each comprise a printing cylinder coupling interface that is complementary to the standard coupling interface such that the standard coupling interface can couple to each of the at least two printing cylinders via the standard coupling interface on the printing tool handling unit and the complementary printing cylinder coupling interface on each of the at least two printing cylinders, wherein the complementary printing cylinder coupling interfaces are identical to each other.

16. The printing assembly according to claim 15, wherein at least one of the at least two printing cylinders is a roller assembly comprising a shaft and a sleeve mounted onto the shaft, wherein the complementary coupling interface of the at least one of the at least two printing cylinders is located at an end of the shaft.

17. The printing assembly according to claim 15, wherein at least one of the at least two printing cylinders is formed as a beam, and wherein the complementary coupling interface of the at least one of the at least two printing cylinders is located at an end of the beam.

18. The printing assembly according to claim 15, wherein the printing tool handling unit is an industrial robot and comprises an end effector, and wherein the standard coupling interface of the printing tool handling unit is mounted on or provided at the end effector.

19. A printing assembly comprising:

a printing machine with a printing module having a flexographic printing mode and a gravure printing mode, wherein the printing module comprises at least two printing cylinders defining the flexographic printing mode and the gravure printing mode of the printing module, each of the at least two printing cylinders comprising a printing cylinder sleeve, and a printing tool handling unit being configured for withdrawing and inserting the at least two printing cylinders from and into the printing module, respectively, without having to manually manipulate the printing cylinder sleeve of each of the at least two printing cylinders;

wherein the printing tool handling comprises a standard coupling interface and the at least two printing cylinders each comprise a printing cylinder coupling interface that is complementary to the standard coupling interface such that the standard coupling interface can couple to each of the at least two printing cylinders via the standard coupling interface on the printing tool handling unit and the complementary printing cylinder coupling interface on each of the at least two printing cylinders.

20. The printing assembly of claim 19, wherein at least one of the at least two printing cylinders is a roller assembly comprising a shaft, wherein the complementary coupling interface of the at least one of the at least two printing cylinders is located at an end of the shaft.

* * * * *